US011564489B2

(12) United States Patent
Siekmann

(10) Patent No.: US 11,564,489 B2
(45) Date of Patent: Jan. 31, 2023

(54) FURNITURE SYSTEM

(71) Applicant: Siematic Möbelwerke GmbH & Co. KG, Löhne (DE)

(72) Inventor: Ulrich Wilhelm Siekmann, Löhne (DE)

(73) Assignee: Siematic Möbelwerke GmbH & Co. KG, Löhne (DE)

( * ) Notice: Subject to any disclaimer, the term of this patent is extended or adjusted under 35 U.S.C. 154(b) by 47 days.

(21) Appl. No.: 17/253,189

(22) PCT Filed: Apr. 17, 2019

(86) PCT No.: PCT/EP2019/059916
§ 371 (c)(1),
(2) Date: Dec. 17, 2020

(87) PCT Pub. No.: WO2019/242910
PCT Pub. Date: Dec. 26, 2019

(65) Prior Publication Data

US 2021/0259410 A1 Aug. 26, 2021

(30) Foreign Application Priority Data

Jun. 19, 2018 (DE) ..... 202018103454.5

(51) Int. Cl.
*A47B 57/42* (2006.01)
*A47B 47/04* (2006.01)
*A47B 96/14* (2006.01)

(52) U.S. Cl.
CPC ..... *A47B 57/425* (2013.01); *A47B 47/04* (2013.01); *A47B 96/1408* (2013.01); *A47B 96/1416* (2013.01); *A47B 2230/0074* (2013.01)

(58) Field of Classification Search
CPC ..... A47B 57/425; A47B 47/04; A47B 47/00; A47B 96/1408; A47B 96/1416; A47B 2230/0074
See application file for complete search history.

(56) References Cited

U.S. PATENT DOCUMENTS 3,193,885 A 7/1965 Lloyd
3,360,321 A * 12/1967 Novales ..... A47B 47/03 312/263

(Continued)

FOREIGN PATENT DOCUMENTS

FR 2619494 A 2/1989
FR 2619494 A1 2/1989

(Continued)

OTHER PUBLICATIONS

WIPO, International Search Report (on a related application), dated May 20, 2019.

(Continued)

*Primary Examiner* — Devin K Barnett
(74) *Attorney, Agent, or Firm* — Laurence P. Colton; Smith Tempel Blaha LLC

(57) ABSTRACT

A furniture system with mounting rails fastened to a wall or rear wall and which have openings, and suspension portions connected to stockage elements that can be suspended in said openings. The furniture system further has a rear wall which extends, with two longitudinal narrow sides, substantially in the vertical direction and which rests on or is fastened to the mounting rails, wherein a strip-like rear wall side part is arranged in parallel with one longitudinal narrow side, in parallel with both longitudinal narrow sides of the rear wall, and which rests on or is fastened to the mounting rail. A recess or gap is formed in a transition region from the rear wall to the rear wall side part, between the longitudinal (Continued)

narrow side of the rear wall and the longitudinal narrow side of the rear wall side part, allowing access to openings of a mounting rail.

10 Claims, 5 Drawing Sheets

(56) References Cited

U.S. PATENT DOCUMENTS 3,394,507 A * 7/1968 Doke ..... E04B 2/7854 52/363
3,570,198 A 3/1971 Ruhnke
3,730,477 A * 5/1973 Wavrunek ..... A47F 5/08 52/36.6
3,828,495 A * 8/1974 Law ..... E04B 2/78 52/36.6
3,976,344 A * 8/1976 Frydman ..... F16B 12/02 312/265.5
4,265,500 A * 5/1981 Berton ..... A47B 47/025 312/265.6
4,370,838 A * 2/1983 Vermillion ..... E04F 13/0814 52/36.6
4,426,935 A * 1/1984 Nikoden, Jr. ..... A47B 47/03 312/265.5
4,441,300 A * 4/1984 Varon ..... E04B 2/78 52/36.6
4,443,979 A * 4/1984 Varon ..... E04B 2/78 52/36.6
4,570,390 A * 2/1986 Wendt ..... E04B 2/7457 52/36.6
5,022,721 A * 6/1991 Melgers ..... A47B 57/52 312/257.1
5,380,083 A * 1/1995 Jones ..... H02B 1/38 312/265.6
5,382,088 A * 1/1995 Young ..... A47B 43/04 312/265.5
5,517,795 A * 5/1996 Doke ..... E04F 13/081 248/243
5,639,150 A * 6/1997 Anderson ..... H02B 1/308 312/265.5
5,806,946 A * 9/1998 Benner ..... H05K 7/183 312/265.5
5,807,618 A * 9/1998 Shiota ..... A47B 96/205 428/116
5,897,180 A * 4/1999 Singer ..... A47B 47/05 312/265.5
5,951,131 A * 9/1999 Stefan ..... A47B 47/02 312/265.5
6,007,170 A * 12/1999 Liebertz ..... A47B 88/941 312/265.5
6,209,976 B1 * 4/2001 Shear ..... A47B 47/02 312/263
6,238,029 B1 * 5/2001 Marzec ..... H02B 1/565 312/265.5
6,478,391 B1 * 11/2002 Stoever ..... A47B 47/02 312/265.5
6,550,879 B1 * 4/2003 Kurrasch ..... A47B 87/00 312/265.5
6,637,353 B2 * 10/2003 Alizade ..... E05G 1/024 109/78
6,657,861 B2 * 12/2003 Irmer ..... H02B 1/50 312/265.5
6,791,027 B1 * 9/2004 Nicolai ..... H02B 1/306 312/265.6
7,784,626 B2 * 8/2010 Jacques ..... A47B 96/1416 211/103
7,866,770 B2 * 1/2011 Wu ..... A47B 47/02 312/263
8,083,301 B2 * 12/2011 Hudz ..... H02B 1/01 312/265.5
9,366,470 B2 * 6/2016 Hastürk et al. ..... F25D 11/00
9,709,207 B1 * 7/2017 Huang ..... B29C 64/25
10,264,882 B1 * 4/2019 Lai ..... A47B 96/04
2003/0164664 A1 * 9/2003 Allexon ..... B65H 31/00 312/265.5
2004/0090156 A1 * 5/2004 Kunanantakul ..... A47B 47/025 312/257.1
2005/0248242 A1 * 11/2005 Yang ..... A47B 47/0075 312/257.1
2008/0246375 A1 * 10/2008 Berg ..... A47B 47/0066 312/265.5
2008/0272677 A1 * 11/2008 Francisquini ..... H02B 1/301 312/257.1
2009/0251035 A1 * 10/2009 Cash ..... A47B 47/042 312/265.5
2009/0302726 A1 * 12/2009 Eckartsberg ..... F25D 23/067 29/700
2010/0258692 A1 * 10/2010 Kluge ..... A47B 96/1466 248/250
2013/0160483 A1 6/2013 Hastuerk
2013/0264924 A1 * 10/2013 Tusk ..... A47B 47/0041 312/265.5
2014/0132128 A1 * 5/2014 Simon ..... A47F 3/0478 312/116
2016/0088936 A1 * 3/2016 Mitchell ..... A47B 47/042 312/265.5
2016/0123655 A1 * 5/2016 Chow ..... F25D 23/067 312/405
2020/0069048 A1 * 3/2020 Derelöv ..... F16B 12/24

FOREIGN PATENT DOCUMENTS

JP H0593313 U 12/1993
JP 2005205085 A 8/2005
WO 2007110262 A1 10/2007
WO 2008095766 A2 8/2008

OTHER PUBLICATIONS

WIPO, Written Opinion (on a related application), dated Dec. 26, 2019.
Japan Patent Office, search in a related application (translated into German), Feb. 25, 2022.

* cited by examiner

FURNITURE SYSTEM

CROSS REFERENCE TO RELATED APPLICATIONS

This application is the US National Phase of and claims the benefit of and priority on International Application No. PCT/EP2019/059916 having an international filing date of 17 Apr. 2019, which claims priority on German Patent Application No. 20 2018 103 454.5 having a filing date of 19 Jun. 2018.

BACKGROUND OF THE INVENTION

Technical Field

The invention relates to a furniture system.

Prior Art

Corresponding furniture systems are known. In general, vertically extending mounting rails are used, usually fastened to the wall, on which rails racks or shelves are mounted. For this purpose, the mounting rails generally comprise a plurality of openings which are arranged one behind the other in the longitudinal direction of the mounting rail and in which corresponding brackets or other components can be suspended via suspension portions located thereon. In this way, depending on the number of mounting rails used, a larger or smaller, and flexible, shelf system results. These types of shelf systems are widespread. A disadvantage thereof is that they generally offer largely open storage space. This is disadvantageous in locations where large amounts of dust or dirt accumulate, since the objects stored in the furniture wall system designed in this manner are of course exposed to this dust or dirt. In addition, open designs are not desired in all locations, in particular not in locations where adjustments to the surrounding furniture may be required. This applies for example for the field of fitted kitchens, since here a uniform front design of the furniture is generally considered important.

BRIEF SUMMARY OF THE INVENTION

The object of the present invention is therefore that of developing a furniture system such that it can fit in well, visually, in existing situations, for example.

This object is achieved by a furniture system comprising mounting rails, which are in particular to be fastened to a wall or rear wall and which comprise openings in which suspension portions connected to stockage elements are suspended or can be suspended, comprising a rear wall which extends, with two longitudinal narrow sides, substantially in the vertical direction and which rests on or is fastened to the mounting rails, wherein furthermore at least one in particular strip-like rear wall side part is arranged at least in parallel with one longitudinal narrow side, in particular in parallel with both longitudinal narrow sides of the rear wall, which rear wall side part rests on or is fastened to the mounting rail, wherein a recess, in particular a gap, in a transition region from the rear wall to the rear wall side part, in particular between the longitudinal narrow side of the rear wall and the longitudinal narrow side of the at least one rear wall side part, which gap allows access to at least some of the openings of a mounting rail. Advantageous embodiments can be found in the dependent claims.

The furniture system according to the invention expands the options of the conventional suspension system with perforated strips and brackets, in that a person skilled in the art now has the possibility of optionally also building carcass walls around the stockage elements suspended in the mounting rails. In this way, it is possible for various furniture frontages to be used, the appearance of which can be individually fitted into the surrounding environment, in particular kitchen environment.

For this purpose, the furniture system according to the invention preferably, but not essentially, comprises mounting rails which are to be fastened to a rear wall or wall and comprise openings in which suspension portions connected to stockage elements are suspended or can be suspended. According to the invention, the furniture system is now provided with a rear wall which extends, with two longitudinal narrow sides, substantially in the vertical direction, and which rests on or is fastened to the mounting rails. In the simplest case, said fastening can be achieved by means of angle pieces proceeding from the rear face of the rear wall facing the wall. Of course, the rear wall can also be directly screwed or otherwise connected to the mounting rails.

In addition, at least one, in particular strip-like, rear wall side part is arranged at least in parallel with one longitudinal narrow side, in particular in parallel with both longitudinal narrow sides, of the rear wall. Said rear wall side part rests on the mounting rail or is fastened thereto, a recess, in particular a gap, being formed in the transition region from the rear wall to the rear wall side part, in particular between the longitudinal narrow side of the rear wall and the longitudinal narrow side of the at least one rear wall side part. The rear wall side part, just like the rear wall itself, can be attached to the rear face pointing towards the wall, using fastening elements such as angles or the like. The multi-part rear wall makes it possible for a recess, in particular a gap, formed between the rear wall and the rear wall side part, to allow for access to at least some of the openings of a mounting rail. A rear wall design of this kind makes it possible to cover the mounting rails and to already design the rear walls so as to correspondingly match the surroundings.

In this case, the gap goes not have to be formed so as to be continuous over the entire longitudinal extension of the rear wall side parts. A gap that allows access to just one or a few openings is likewise conceivable. In a preferred embodiment, the rear wall and the at least one rear wall side part can come into contact in places, in particular at the portions at which no recess is arranged. In this case, it is even possible for the rear wall and the at least one rear wall side part to be formed integrally. This would lead to greater stability of the rear face.

In a further preferred embodiment the recess(es) formed between the rear wall and the rear wall side part or the rear wall side parts, in particular the gap(s), is/are designed so as to be continuous from top to bottom, and it/they allow(s) access to almost all openings of the wall mounting strip(s).

In order for it to remain possible to also suspend stockage elements, such as shelf bottoms or storage compartments, with or without pull-outs, retrospectively, i.e. following installation of the furniture system, it may be possible for the gap(s) formed between the rear wall and the rear wall side part or the rear wall side parts to be flush with the openings of the wall mounting strip(s) located therebehind.

According to a particularly preferred embodiment of the present invention, each rear wall side part comprises fastening portions on the longitudinal narrow side thereof remote from the rear wall, on which fastening portions a carcass side part is to be attached or is attached. In this way, it is possible not only for the rear wall design to be matched to the surroundings, but for an entire furniture carcass to be built around the stockage elements.

In addition, it is possible in particular for the fastening portions to comprise a drilled hole extending obliquely to the longitudinal extension of the rear wall side part, in which drilled holes a fastening element, in particular an expansion and/or eccentric dowel can be received or is received. In this way, it is possible for carcass side walls to be very easily attached, in conventional form, to the rear wall side parts.

According to a particularly preferred embodiment, the furniture system comprises one rear wall side part, respectively, on both longitudinal sides of at least one rear wall. One carcass side wall, in each case, is then arranged on and/or attached to the longitudinal narrow sides of the rear wall side elements remote from the rear wall. It may in addition be possible for the two carcass side walls to be connected, in the upper region thereof in the vertical extension direction, to a carcass upper part and, in the lower region thereof in the vertical extension direction, to a carcass lower part. Thus, a carcass furniture element results, in which the stockage elements are accessible from the front side. Alternatively, or in addition thereto, it may be possible for a carcass front part to be attached between the two carcass side walls. As a result, the resultant carcass furniture can also be closed from the front side, and thus protect the contents from dust and impurities.

The material for the carcass parts can be selected as desired. It may preferably be possible for at least one carcass side wall and/or the carcass front part to consist of or comprise i) a transparent material, in particular glass, and/or ii) a wood or wood substitute material, and/or plastics material.

A person skilled in the art will make the selection depending on the corresponding surroundings to which the furniture system according to the invention is intended to be matched.

It may also be possible for the rear wall and/or the rear wall side parts to consist of or comprise a wood or wood substitute material, and/or plastics material, and/or a composite material of wood and stone.

Specifically when using glass parts, generally corresponding profiles are used for connection to other side parts, in particular metal profiles such as aluminum profiles, into which the glass parts are inserted or with which the glass parts are connected. A furniture wall system appears particularly high-quality if the rear side consists of a composite material of wood and stone, or comprises said material.

BRIEF DESCRIPTION OF THE DRAWINGS

The invention will be explained in greater detail in the following, with reference to FIGS. 1-5.

DETAILED DESCRIPTION OF PREFERRED EMBODIMENTS

Figure 1:
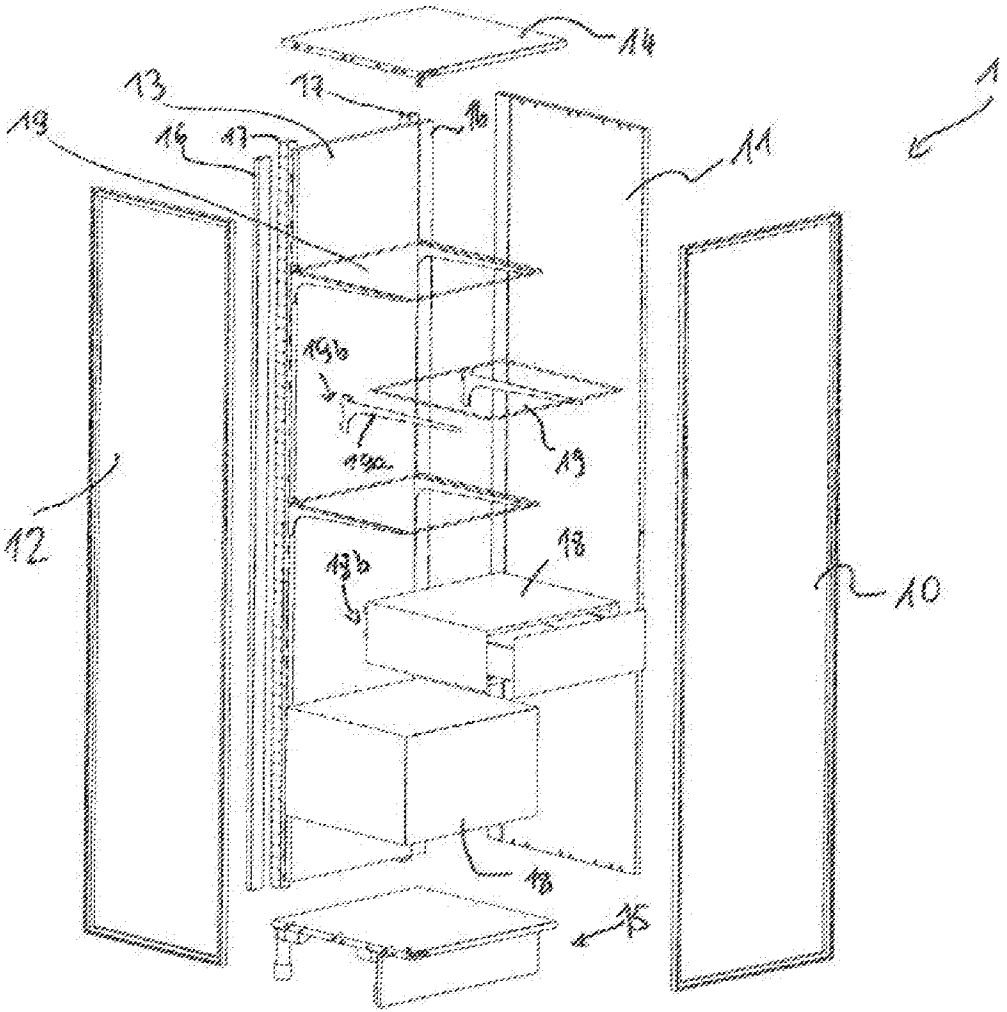
FIG. 1 is an exploded view of a furniture system according to the invention, given by way of example.

The embodiment, shown in FIG. 1, of a furniture system 1 according to the invention shows two mounting rails 17 which are arranged so as to be oriented perpendicularly and so as to be mutually parallel. Preferably, but not essentially, said mounting rails can be fastened or designed so as to be able to be fastened to a rear wall or wall.

Figure 2:
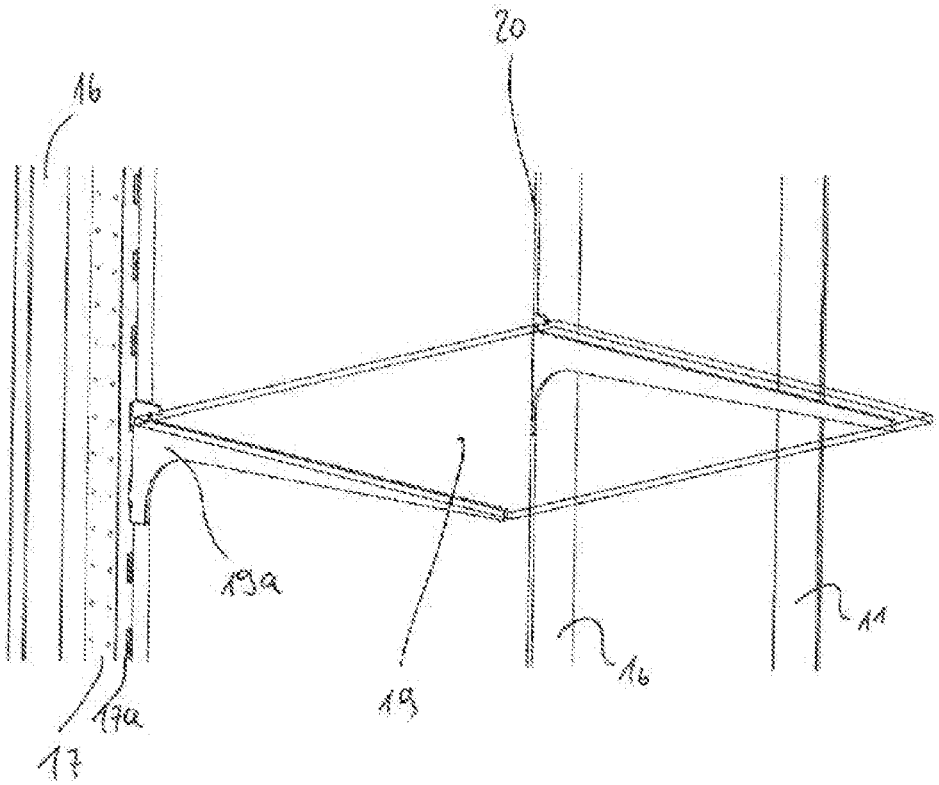
FIG. 2 is an enlarged detail from FIG. 1.
Figure 5:
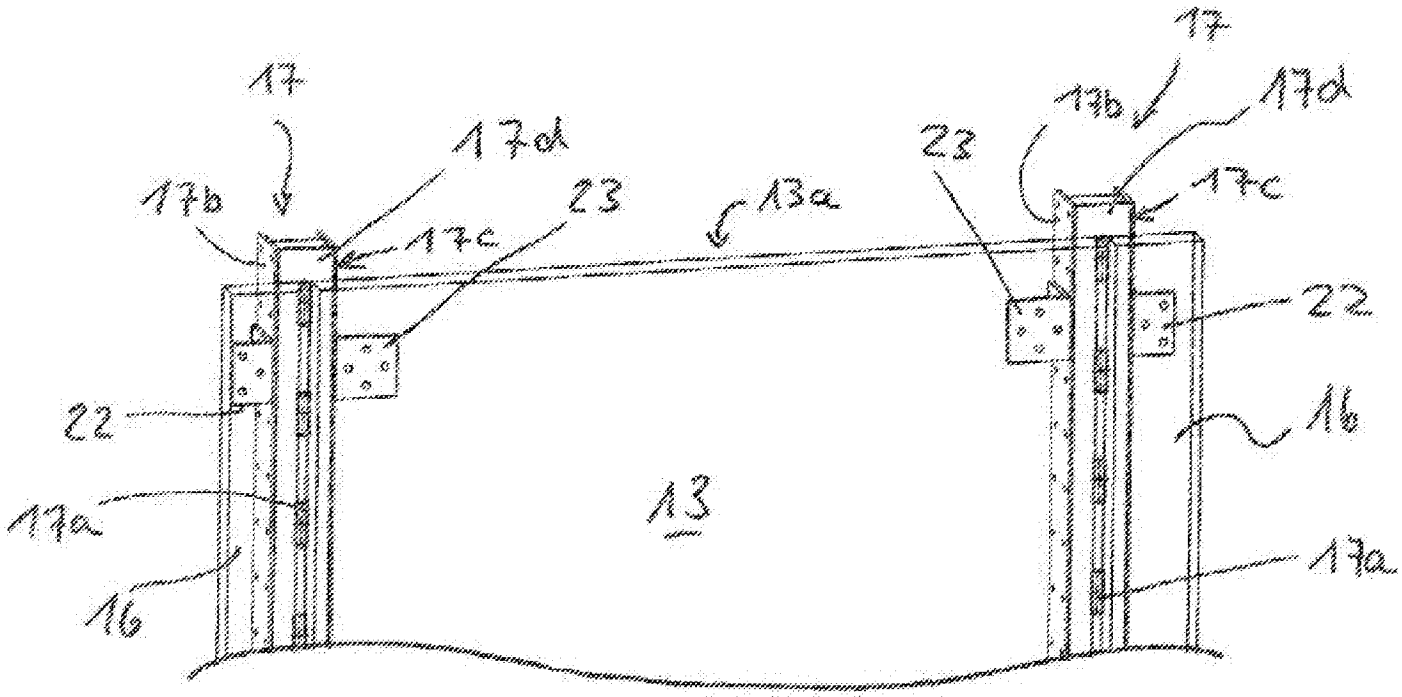
FIG. 5 is an enlarged detail of the part shown in FIG. 3, comprising additional fastening elements.

As shown in FIGS. 2 and 5, the mounting rails 17 comprise, on the front side 17*d* thereof, a plurality of openings 17*a* that are arranged in the longitudinal direction of the mounting rails 17. Suspension portions 18*b*, 19*b* connected to stockage elements 18, 19 can be suspended in the openings 17*a*.

The mounting rails 17 are provided with a rear wall 13 which extends substantially in the vertical direction. In this case, the height of the rear wall 13 corresponds approximately to the length of the mounting rails 17, the width of the rear wall 13 is designed such that it covers the mounting rail 17 to such an extent that the openings 17*a* for the suspension portions 18*b*, 19*b* remain accessible. In this case, the rear wall 13 can rest on the mounting rails 17 or be fastened thereto. In each case a preferably strip-like rear wall side part 16 is arranged in parallel with the two longitudinal narrow sides of the rear wall 13. Said rear wall side parts in each case rest on one of the mounting rails 17 or are fastened thereto. In this case, the two rear wall side parts 16 are arranged such that in each case a gap 20 is formed between the longitudinal narrow side of the rear wall 13 and the longitudinal narrow side of the rear wall side part 16, as is shown in FIG. 2. Together with the mounting rails 17, the rear wall 13, together with the rear wall side parts 16, forms the rear face of the furniture system 1.

During assembly, the suspension portions 18*b*, 19*b* of the stockage elements 18, 19 are suspended in the openings 17*a* of the mounting rails 17, through the slits 20. In this case, the stockage elements 19 can be shelf bottoms which are arranged on carrier elements 19*a* with the suspension portions 19*b*. Stockage elements 18 are also conceivable which have a carcass around the stockage region, it being possible for the stockage region to be opened for example by means of a drawer or a door. Furthermore, the stockage element 18, 19 may also be a carrier for a technical element, such as a kitchen device.

Figure 3:
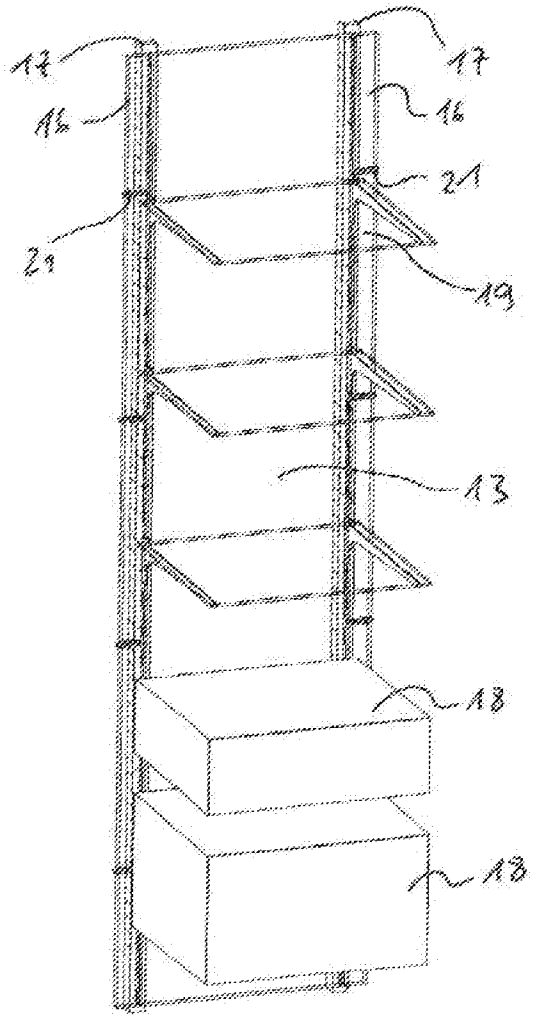
FIG. 3 is a perspective view of a part of a furniture system according to the invention.
Figure 4:
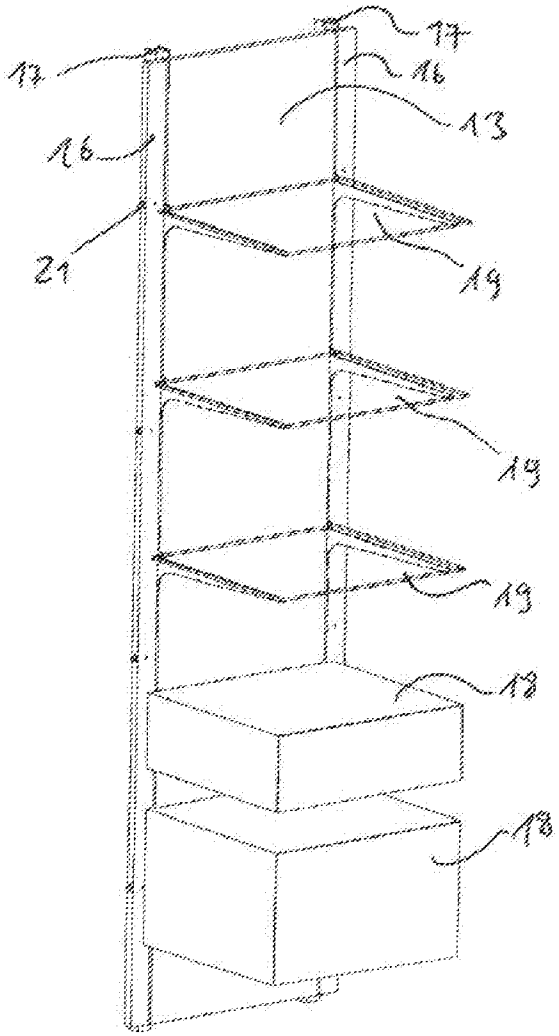
FIG. 4 is a different perspective view of the part shown in FIG. 3.

FIGS. 3 and 4 show a part of a furniture wall system 1 according to the invention, in which the rear face consists of the mounting rails 17, the rear wall 13, and the rear wall side parts 16. Various stockage elements 18, 19 are suspended in the mounting rails. Fastening portions 21 are arranged obliquely to the longitudinal extension of the rear wall side parts 16, drilled holes being made in the rear wall side parts 16, in which holes fastening elements can be received. In this case, the fastening elements are preferably expansion and/or eccentric dowels.

Said fastening portions 21 make it possible for the carcass side parts 11, 12, shown in FIG. 1, to be attached, in conventional form, to the rear wall side parts 16. The two carcass side parts 11, 12 are connected to a carcass upper part 14 in the upper region, and to a carcass lower part 15 in the lower region. The embodiment of the furniture wall system 1 shown here is equipped with a carcass front part 10, the carcass front part 10 being designed as a door. It is not necessary to form a carcass front part 10 integrally, but it is also conceivable to provide a plurality of doors as carcass front parts 10, in order to open just one part of the front in each case. It is also possible for the carcass front part 10 to consist of drawer face plates or a mixture of the two.

FIG. 5 shows the top portion of a rear face of a furniture system 1 according to the invention. The mounting rails 17 which are attached to a wall (not shown) or merely connect the rear wall 13 to the rear wall side parts 16 comprise, on the front side 17*d*, a plurality of openings 17*a* which are arranged one behind the other in the longitudinal direction of the mounting rails 17, and in which the suspension portions 18*b*, 19*b* of the stockage elements 18, 19 can be suspended. A plurality of retaining elements, in a double row, in each case, is arranged on the sides 17*b*, 17*c*. The retaining elements are preferably threaded holes which serve to fix the fastening elements 22, 23 which are arranged on the rear wall 13 or on the rear wall side parts 16. In the case of the rear wall 13, all that is required, during fixing, is to prevent sliding downwards. The fastening elements 23, which are designed here, by way of example, as fastening angles, prevent lateral displacement by way of support on the mounting rails 17, while the stockage elements 18, 19 fix the rear wall to the mounting rails 17 in the depth direction. It is thus possible, according to a preferred embodiment, to provide the parts of the fastening elements 23 resting on the sides 17*b*, 17*c* with lugs which latch into the retaining elements upon mounting, and thus prevent the rear wall 13 from sliding. This is advantageous insofar as, during mounting, the fastening elements 23 are accessible for mounting tools only via the gap formed at the upper edge 13 of the rear face 13, with the wall.

Since the rear wall side parts 16 cannot be clamped between two mounting rails 17, it is recommended to screw the fastening elements 22 to retaining elements of the sides 17*b*, 17*c* of the mounting rails 17.

A furniture system 1 according to the invention can be designed in a very flexible manner, and thus opens up a high degree of variability of use, it being able to be fitted in well, optically, in existing situations.

The invention claimed is:

1. A furniture system comprising:

mounting rails fastened to a wall, the mounting rails each comprise openings wherein suspension portions connected to stockage elements are suspended therefrom;

a rear wall which extends, with two longitudinal sides, substantially in a vertical direction and which rests and is fastened to the mounting rails;

at least one rear wall side part arranged in parallel with both longitudinal narrow sides of the rear wall, wherein a first longitudinal side of the at least one rear wall side part rests on and is fastened to a respective one of the mounting rails by fastening elements;

a gap between one of the longitudinal sides of the rear wall and the longitudinal side of the at least one rear wall side part, the gap is in front of the entire respective one of the mounting rails, wherein the gap allows access to at least some of the openings of the respective one of the mounting rails; and fastening portions on a second longitudinal side of the at least one rear wall side part, on which fastening portions of a respective carcass side part is attached.

2. The furniture system according to claim 1, wherein the rear wall and the at least one rear wall side part come into contact at points, or are formed integrally.

3. The furniture system according to claim 1, wherein the gap, formed between the rear wall and the at least one rear wall side part, is continuous from top to bottom, and allows access to almost all openings of the respective one of the mounting rails.

4. The furniture system according to claim 1, wherein the gap formed between the rear wall (13) and the at least one rear wall side part is flush with the openings of the respective one of the mounting rails located therebehind.

5. The furniture system according to claim 1, wherein the fastening portions comprise a drilled hole which extends obliquely to the longitudinal extension of the at least one rear wall side part, wherein a fastening element is receivable in the drilled hole.

6. The furniture system according to claim 1, wherein a respective one of the at least one rear wall side part is arranged at each of the longitudinal sides of the rear wall, wherein the respective carcass side part is attached on the second longitudinal side of each respective one of the at least one rear wall side part.

7. The furniture system according to claim 6, wherein the respective carcass side walls part is connected, in an upper region thereof in a vertical extension direction, to a carcass upper part, and, in a lower region thereof in the vertical extension direction, to a carcass lower part.

8. The furniture system according to claim 6, wherein a carcass front part is attached between the respective carcass side walls parts.

9. The furniture system according to claim 7, wherein at least one of the respective carcass side wall parts and/or the carcass front part consist of or comprise at least one material selected from the group consisting of a transparent material, a wood material, a wood substitute material, and a plastic material.

10. The furniture system according to claim 6, wherein the rear wall and/or the at least one rear wall side part consist of or comprise at least one material selected from the group consisting of a wood material, a wood substitute material, a plastic material, and a composite material of wood and stone.

* * * * *